US008038459B2

(12) United States Patent
Hayauchi

(10) Patent No.: US 8,038,459 B2
(45) Date of Patent: Oct. 18, 2011

(54) CONNECTOR PROTECTIVE COVER

(75) Inventor: Takayuki Hayauchi, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/526,374

(22) PCT Filed: Feb. 11, 2008

(86) PCT No.: PCT/US2008/053607

§ 371 (c)(1),
(2), (4) Date: Aug. 7, 2009

(87) PCT Pub. No.: WO2008/100864

PCT Pub. Date: Aug. 21, 2008

(65) Prior Publication Data

US 2010/0323549 A1 Dec. 23, 2010

(30) Foreign Application Priority Data

Feb. 15, 2007 (JP) ..... 2007-035240
Dec. 21, 2007 (JP) ..... 2007-330503

(51) Int. Cl.
*H01R 13/62* (2006.01)

(52) U.S. Cl. ..... 439/301

(58) Field of Classification Search ..... 439/301, 439/304, 133

See application file for complete search history.

(56) References Cited

U.S. PATENT DOCUMENTS

| | | | | |
|---|---|---|---|---|
| 5,190,465 | A * | 3/1993 | Davidge et al. | 439/304 |
| 6,080,009 | A | 6/2000 | Yanagihara et al. | |
| 6,402,535 | B2 | 6/2002 | Okabe et al. | |
| 6,966,789 | B2 | 11/2005 | Takaku et al. | |
| 7,229,316 | B2 | 6/2007 | Takaku et al. | |

FOREIGN PATENT DOCUMENTS

| | | |
|---|---|---|
| JP | 2002231392 | 8/2002 |
| JP | 2006034784 | 2/2006 |

* cited by examiner

*Primary Examiner* — Phuong Dinh
(74) *Attorney, Agent, or Firm* — Robert S. Moshrefzadeh

(57) ABSTRACT

A connector protective cover is provided which has a pair of cover members (2 and 3) to be joined together and which, using the pair of cover members (2 and 3), protects a latch lever that is operated to retain a pair of connectors (10 and 20) in engagement with each other, wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement, and wherein the pair of cover members (2 and 3) joined together in an inseparable manner covers the operating portion and is fixed to the operating portion of the latch lever.

16 Claims, 12 Drawing Sheets

CONNECTOR PROTECTIVE COVER

TECHNICAL FIELD

The present invention relates to a connector protective cover that is used by being attached to a latch lever of a connector. The connector protective cover has a structure such that once the cover is attached to the latch lever, it cannot be detached from without destroying the cover. The connector protective cover is particularly useful in a game machine such as a pachinko machine, a pachinko slot machine, a slot machine, or other machines in which the cover can prevent illegal removal of a connector.

BACKGROUND

Generally, when connecting electrical wires together or when connecting an electrical wire to a circuit board, a pair of connectors having structures detachable from each other is used. A latch mechanism for fastening such a pair of connectors includes, for example, a latch lever on one connector that hooks onto a wall portion of the other connector for engagement or an engaging pawl integrally formed with the wall of one connector that engages with an engaging groove formed in the wall of the other connector. For disengagement, the latch lever is moved by a finger in a disengaging direction, or the wall portions of the connectors are elastically bent to disengage one from the other. By allowing the pair of connectors thus connected to be disconnected in this manner, not only can the connectors be prevented from becoming accidentally disconnected, but the efficiency of making electrical connection can be improved, while the ability to maintain the connection of the devices connected via the pair of connectors is also enhanced.

However, in the field of amusement industry where game balls, game tokens, etc. won from game machines can be exchanged for prizes, illegal tampering of game machines has been a problem, the tampering being often done by connecting a special component similar to the legal electric or electronic component to the game machine via a connector and controlling the game machine in an illegal way. Such illegal components are skillfully made and resemble the legal ones so close that externally they are often not easily distinguishable, making it difficult to discover the illegal tampering.

In view of the above situation, various strategies have been employed in the amusement industry related field to prevent illegal tampering of game machines. In one method, a pair of connectors is made inseparable by gluing them together with an adhesive or the like, thus rendering the connection of an illegal component itself impossible. This method, however, has the problem that if any component connected via such connectors to the game machine becomes defective and has to be replaced with a new component, the pair of connectors has to be destroyed.

In another example, a structure that can make a pair of connectors not easily separable without gluing them together is disclosed in Japanese Unexamined Patent Publication No. 2006-34784. This reference discloses a connector cover that covers a board connector and a cable connector in such a manner that the mated connectors are not visible from the outside. The interior side of the connector cover has a large number of engaging protrusions that engage with engaging portions formed on the walls, etc. of the pair of connectors. With the engaging protrusions of the connector cover engaging with the engaging portions formed on the walls of the connectors, the connector cover is fixed, e.g., coupled or attached, onto the pair of connectors.

The connector cover cannot be removed from the connectors without destroying the cover itself. When, for example, the game machine has failed, the failed electronic component is replaced by destroying only the cover but not destroying the pair of connectors, so that the pair of connectors can be connected once again. If the game machine has been tampered with, the tampering can be discovered visually, as the connector cover is destroyed.

Because this connector cover is formed in a box-like shape to cover the entire structure of the paired connectors, an additional space for mounting the connector cover has to be provided around the connectors. This has led to the problem that the connector cover cannot be mounted to the connectors if there is no mounting space around the connectors in the game machine.

Further, depending on the mounting conditions of the connectors and the connector cover, a gap may be formed between the connectors and the connector cover, resulting in insufficient engagement between the engaging portions of the connectors and the engaging protrusions of the connector cover, or deformation of the connector cover due to application of an external force, the connector cover thus tending to easily disengage.

In view of the above problems, it is an object of at least one embodiment of the present invention to provide a connector protective cover that can prevent illegal removal of connectors, and that has a compact structure not requiring an extra mounting space.

SUMMARY

According to one embodiment of the present invention, there is provided a connector protective cover suitable for protecting a latch lever that is operated to retain a pair of connectors in engagement with each other; wherein the latch lever has an operating portion and an engagement effecting portion, the operating portion being operable to move the engagement effecting portion between an engaging position where the pair of connectors are retained in engagement with each other and a disengaging position where the pair of connectors are released from the engagement, the connector protective cover comprising a pair of mating cover members configured to protect the latch lever; wherein the pair of cover members are configured to join together in a secure manner accommodating one or both of the operating portion and the engagement effecting portion of the latch lever and are further configured to couple with one or both of the connector and the latch lever.

According to one embodiment of the present invention, there is provided an article comprising a connector protective cover and a pair of engaged connectors at least one of the connectors having a latch lever to retain their engagement with each other, the connector protective cover having a pair of mating cover members to be joined together to protect the latch lever; wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement; and wherein the pair of cover members joined together in a secure manner accommodate one or both of the operating portion and engagement effecting portion and are fixed to one or both of the connector and the latch lever.

According to one embodiment of the present invention, there is provided a connector protective cover which comprises a pair of cover members to be joined together and which, using the pair of cover members, protects a latch lever that is operated to retain a pair of connectors in engagement with each other, wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement, and wherein the pair of cover members joined together in an inseparable manner cover the operating portion and are fixed, e.g., coupled or attached, to one of the connectors that is equipped with the latch lever.

According to another embodiment of the present invention, there is provided a connector protective cover to be mounted on a latch lever that is provided either on a direct-mount connector directly mounted to a circuit board or on a cable connector connected to a cable and that is operated to retain the direct-mount connector and the cable connector in engagement with each other, wherein a board cover having an opening passing therethrough to define a mounting space for mounting the direct-mount connector in a position to which the direct-mount connector is to be fixed, e.g., coupled or attached, is rigidly mounted on an upper surface of the circuit board, and the latch lever has an operating portion and an engagement effecting portion, the operating portion being operable to move the engagement effecting portion between an engaging position where the pair of connectors are retained in engagement with each other and a disengaging position where the pair of connectors are released from the engagement, wherein the connector protective cover has a body which is to be mounted at least on the engagement effecting portion, a leg portion which engages with a wall portion formed around the opening of the board cover, and a restraining portion which retrains movement of the engagement effecting portion by abutting against an outside face of the engagement effecting portion with the leg portion engaged with the wall portion formed around the opening.

According to at least one embodiment of the present invention, as the operating portion of the latch lever is covered with the pair of cover members, the operating portion cannot be operated, and illegal removal of the connectors can thus be prevented. Compared with the cover that covers the entire structure of the connectors, the pair of cover members which cover only the operating portion serves to make the protective cover compact and reduce the mounting space of the protective cover.

According to at least one embodiment of the present invention, illegal removal of the connectors can be directly prevented with the pair of cover members restraining the movement of the engagement effecting portion of the latch lever. Compared with the cover that covers the entire structure of the connectors, the pair of cover members which cover only the engagement effecting portion serves to make the protective cover compact and reduce the mounting space of the protective cover.

According to at least one embodiment of the present invention, when the pair of cover members are joined together, the engaging portion engages with the mating portion thereby retaining the pair of cover members in engagement with each other.

According to at least one embodiment of the present invention, when the paired cover members need to be separated, the cover members can be easily separated by cutting the breakage facilitating portion by using a suitable tool such as nippers.

According to at least one embodiment of the present invention, as the hinge portion also serves as the breakage facilitating portion, the breakage facilitating portion can be provided without adding an extra structure.

According to at least one embodiment of the present invention, the protective cover comprising the pair of cover members can be prevented from disengaging from the operating portion, or the operating portion can be prevented from deflecting or moving inside the pair of cover members, and thus the operation of the operating portion can be reliably disabled.

According to at least one embodiment of the present invention, as the structure of the protective cover is made further simple and compact, and the outward projection of the operating portion is correspondingly reduced, the structure is less susceptible to mounting space constraints.

According to at least one embodiment of the present invention, as the breakage facilitating portion is provided in the connecting portion, the paired cover members can be easily separated.

According to at least one embodiment of the present invention, as the pair of connectors are mounted to electrically connect between a circuit board and a flat cable, it becomes possible to prevent illegal tampering which is done, for example, by illegally controlling a game machine or the like mounted with the circuit board. Further, if the pair of cover members are destroyed, the illegal tampering can be easily discovered as the destroyed cover members provide the evidence of tampering.

According to at least one embodiment of the present invention, with the leg portion of one of the cover members engaging with the wall portion formed around the opening of the board cover, the cover member is held in a fixed position relative to the latch lever and, in this condition, the restraining portion butts against the outside face of the engagement effecting portion, restraining the movement of the engagement effecting portion. In this way, illegal removal of the connectors can be prevented in a more reliable manner.

According to at least one embodiment of the present invention, by applying a simple modification to the board cover, the engaging portion for accommodating the leg portion can be easily formed. Accordingly, the cost of the protective cover can be reduced by making effective use of existing parts.

DETAILED DESCRIPTION

Figure 1:
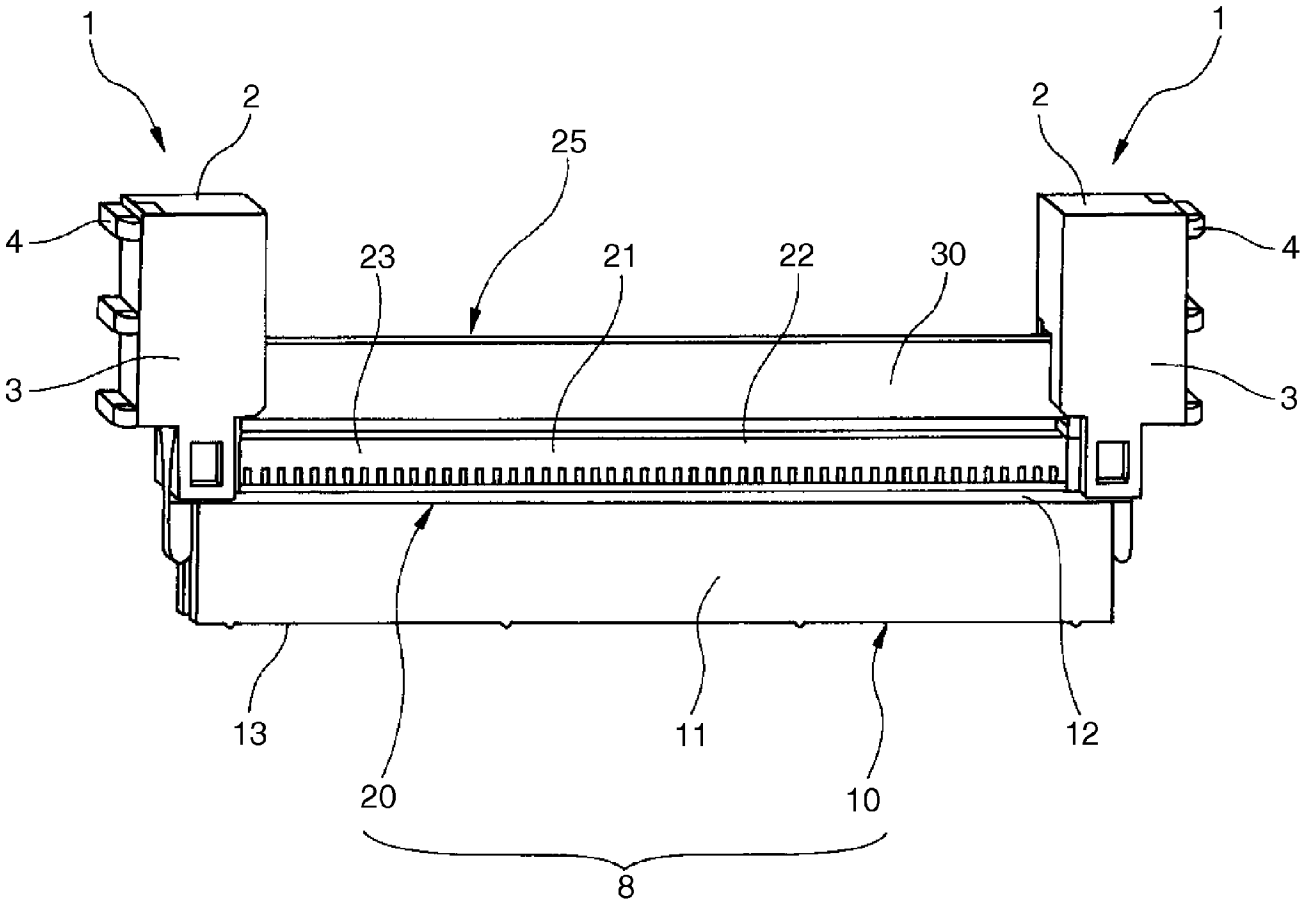
FIG. 1 is a perspective view of a first embodiment of a connector protective cover according to the present invention attached to mated connectors.

Specific examples of embodiments of the present invention will be described in detail below with reference to the drawings. FIG. 1 shows a first embodiment of a connector protective cover according to the present invention. The connector protective cover 1 of this embodiment comprises a pair of mating cover members 2 and 3 which, prior to being fitted together, are initially in a split shape in which they are arranged side-by-side and attached together (see FIG. 3 When a cable connector 20 connected to an end of a flat cable is fitted into a direct-mount (board mount) connector 10 that is vertically fixed, e.g., coupled or attached, to a circuit board (not shown), the cover members are mounted to cover an operating portion of a latch lever 26 (see FIG. 2) which is provided on the cable connector 20 to retain the two connectors 10 and 20 in engagement with each other. The direct-mount connector 10 and the cable connector 20 provided with the latch lever 26 together make up a board connector assembly 8.

The circuit board not shown is one on which circuit conductors are formed in a prescribed pattern by printing or the like, and may be mounted inside a game machine such as a pachinko machine or a pachinko slot machine. Control signals are transferred between the circuit board and an external control unit via the pair of connectors 10 and 20 held in engagement.

The direct-mount connector 10 may be a 40-pin connector comprising a female-type connector housing 11 and a large number of male terminals (not shown) each having at one end a conductor contact for connecting to a wiring conductor formed on the circuit board and at the other end a terminal contact for connecting to a female terminal provided on the cable connector 20, the intermediate portion of each male terminal being formed as a fixed portion which is press-fitted into the wall portion of the connector. The connector housing 11 may be formed by molding a resin into a frame-like shape, and has at its front side an opening forming a female-type fitting portion 12 for accepting the cable connector 20 therein. The "front side" here refers to the side at which the connector 10 is fitted onto the connector 20, that is, the upper side of the connector 10 shown in FIGS. 1 and 2.

In the fitting portion 12, the terminal contacts of the male terminals protrude upward so that they can be connected to the female terminals of the cable connector 20. The conductor contacts of the male terminals protrude downward (not shown) from the bottom wall 13 of the connector housing 11. The board connector 10 is attached to the circuit board, and the conductor contacts are connected to the circuit conductors by brazing or the like. Here, the size of the connector housing 11 is not specifically limited, but can be changed to meet the design specification of the circuit board. If the size of the connector housing 11 is changed, the protective cover 1 of this embodiment can be used as long as the specification of the latch lever 26 is not changed.

Figure 2:
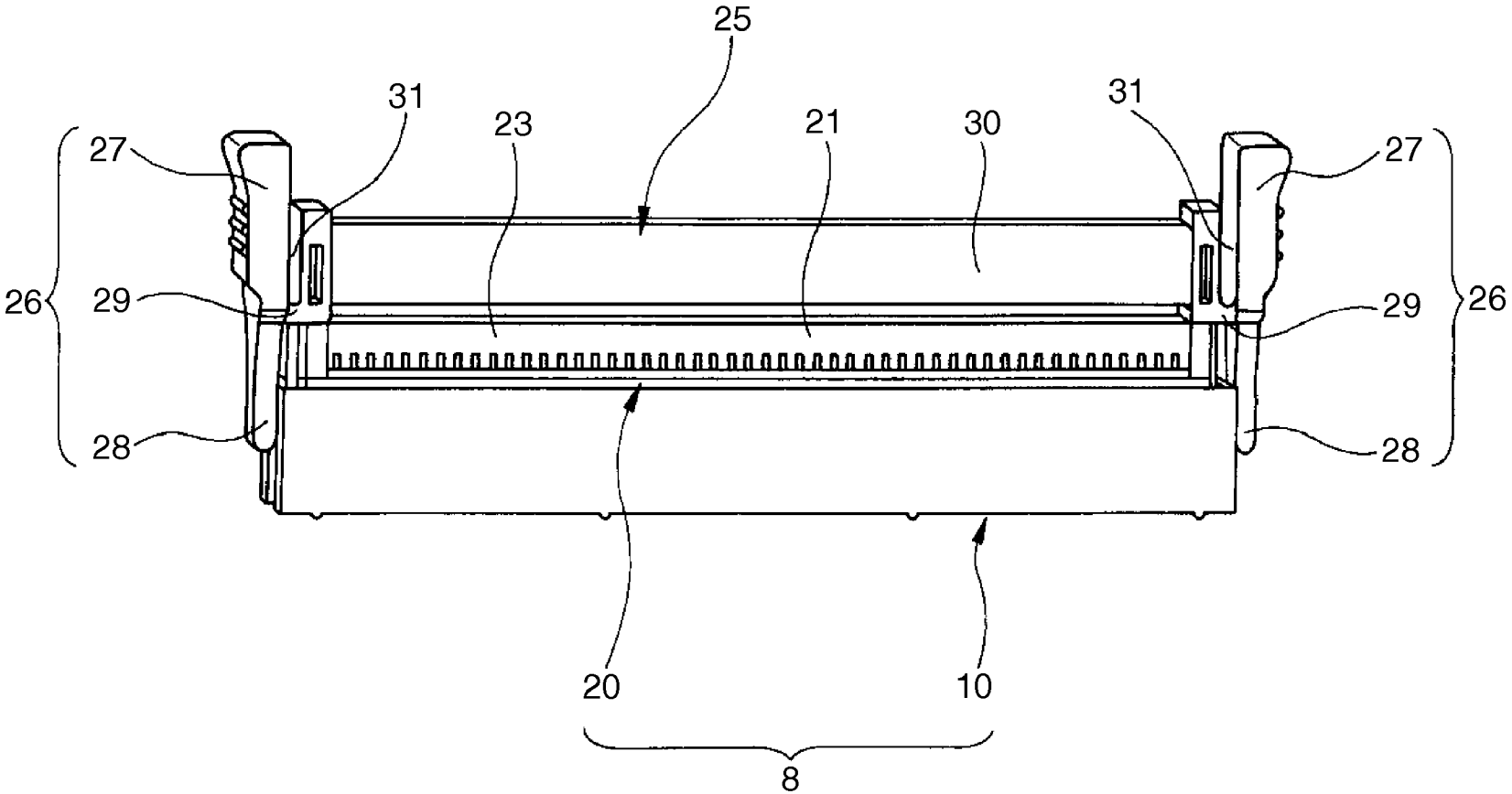
FIG. 2 is a perspective view of the mated connectors of FIG. 1.
Figure 3:
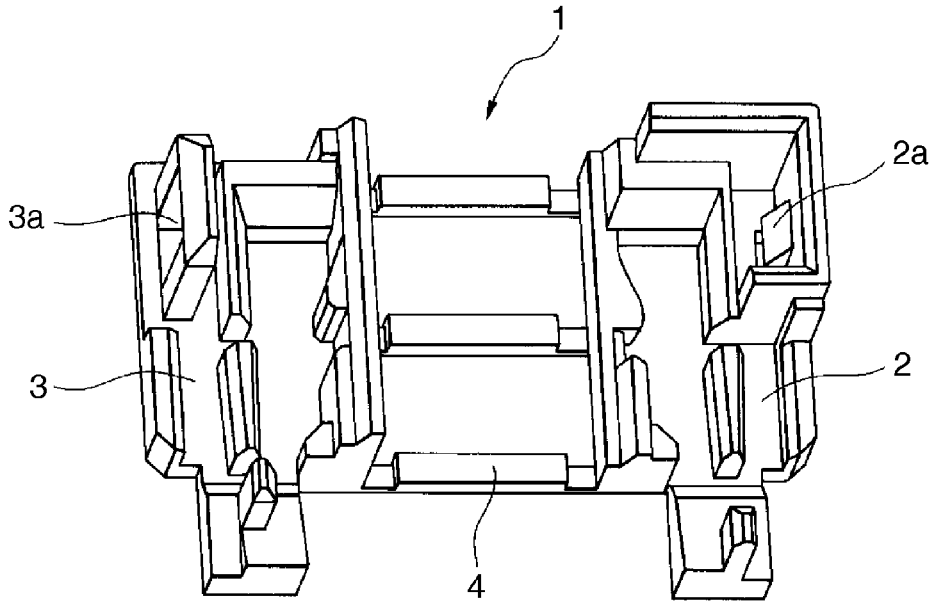
FIG. 3 is a perspective view of the connector protective cover before the cover members are joined together.

As shown in FIG. 2, the cable connector 20 comprises: a connector housing 21 having at its front side a male-type fitting portion (not shown) which is partitioned into a large number of terminal accommodating sections; a large number of female terminals (not shown) accommodated in the respective terminal accommodating sections; and a latch holder 25 fixed, e.g., coupled or attached, to the rear wall portion of the connector housing 21 with the flat cable (not shown) connected to the female terminals and sandwiched between the wall portions of the connector housing 21. Here, the "front side" of the connector housing 21 refers to the side at which the connector 20 is fitted into the connector 10, that is, the lower side of the connector 20 shown in FIGS. 1 and 2.

The connector housing 21 may be formed by molding a resin into a rectangular shape, and may contains a large number of terminal accommodating sections (not shown) that are arranged at a regular pitch in two horizontal rows. Each terminal accommodating section is formed by passing through the front wall (not shown) and the rear wall 22. An electrical contact formed on one side of the female terminal accommodated in each terminal accommodating section is exposed through the front wall, while an electrical contact formed on the other side of the female terminal is exposed through the rear wall 22. A core wire exposed by removing the cover of a corresponding one of signal wires forming the flat cable is press-fitted to each electrical contact. The front wall and the rear wall 22 are connected together by a frame-like wall 23 formed in encircling relationship thereto.

Each female terminal is formed by punching out an electrically conductive plate and bending it, and has at one end an electrical contact portion that elastically contacts a male terminal and at the other end an electrical wire connect portion that is formed as a press-contact portion. The female terminal accommodated in each terminal accommodating section is securely held in position by a securing means (not shown) so as not to come off of the terminal accommodating section.

The latch holder 25 is a lock member for holding the pair of connectors 10 and 20 joined together (in engagement with each other), and comprises a pair of latch levers 26 each integrally formed from a resin and located at opposite longitudinal ends of latch holder 25, the latch levers 26 connected to each other by a connecting portion 30 of latch holder 25. Each latch lever 26 is made up of an operating portion 27 as a force applying point, an engagement effecting portion 28 located at an opposite end from the operating portion 27, and a fulcrum portion 29 located between the operating portion 27 and the engagement effecting portion 28 and connected to one end of the connecting portion 30. An engaging pawl 28*a* (see FIG. 4) which engages with an engaging groove (not shown) formed in the wall of the direct-mount connector 10 may be formed on the inside of the engagement effecting portion 28. A deflection space 31 for allowing the deflection of the operating portion 27 is provided between the operating portion 27 and an end face of the connecting portion 30, while a gap for allowing the insertion of the wall of the fitting portion 12 of the direct-mount connector 10 is provided between the engagement effecting portion 28 and the side face of the connector housing 21.

That is, the engagement effecting portion 28 of the latch lever 26 is allowed to deflect between an engaging position where the pair of connectors are retained in engagement with each other and a disengaging position where the pair of connectors are released from the engagement. When fitting together the connectors 10 and 20, first the operating portion 27 of the latch lever 26 is pressed toward the direction that reduces the deflection space 31 thereby causing the engagement effecting portion 28 to open outward and, after the connectors 10 and 20 are fitted together, the force being applied to press the operating portion 27 is released, allowing the engagement effecting portion 28 to elastically return to its original position and thus causing the engaging pawl 28*a* formed on the inside of the engagement effecting portion 28 to engage with the engaging groove (not shown) formed on the frame wall of the direct-mount connector 10, thus holding the pair of connectors 10 and 20 fixed, e.g., coupled or attached, in position.

By operating the operating portion 27 of the latch lever 26 as described above, the pair of connectors 10 and 20 can be engaged and disengaged relative to each other, allowing the pair of connectors 10 and 20 to be reconnected. When the pair of connectors 10 and 20 are joined together by means of the latch levers 26, accidental disengagement of the connectors 10 and 20 can be prevented, and the reliability of the electrical connection improves.

Next, the protective cover of this embodiment will be described. The protective cover 1 may be attached to the operating portion 27 of the latch lever 26 in order to prevent removal of the connector, thereby preventing, for example, illegal tampering with a game machine. A shown if FIG. 3, the protective cover 1 has a pair of cover members 2 and 3 which are joined together and configured to selectively cover only the operating portion 27 of the latch lever 26. As an alternative mode, the protective cover 1 may be configured to cover not only the operating portion 27 but also the engagement effecting portion 28 of the latch lever 26. The pair of cover members 2 and 3 may be integrally formed with a hinge portion 4 by molding a resin into the appropriate shape. In the present embodiment, the hinge portion 4 consists of three thin separate portions, but instead, the hinge portion 4 may be formed as a single wide portion. The three hinge portions 4 of the present embodiment also serve as breakage facilitating portions that enable the separation of the pair of cover members 2 and 3; that is, by breaking the hinge portions 4, e.g., with nippers or the like, the pair of cover members 2 and 3 can be easily separated from each other. When the hinge portion is formed as a single wide portion, a breakage facilitating portion enabling the separation of the pair of cover members 2 and 3 can be formed in some other portion of the pair of cover members 2 and 3. A person attempting to use a connector for the purpose of illegal tampering with a game machine would likely destroy the separation facilitating portion, so the illegal tampering could be easily discovered as the destroyed portion provides the evidence of tampering.

Figure 4:
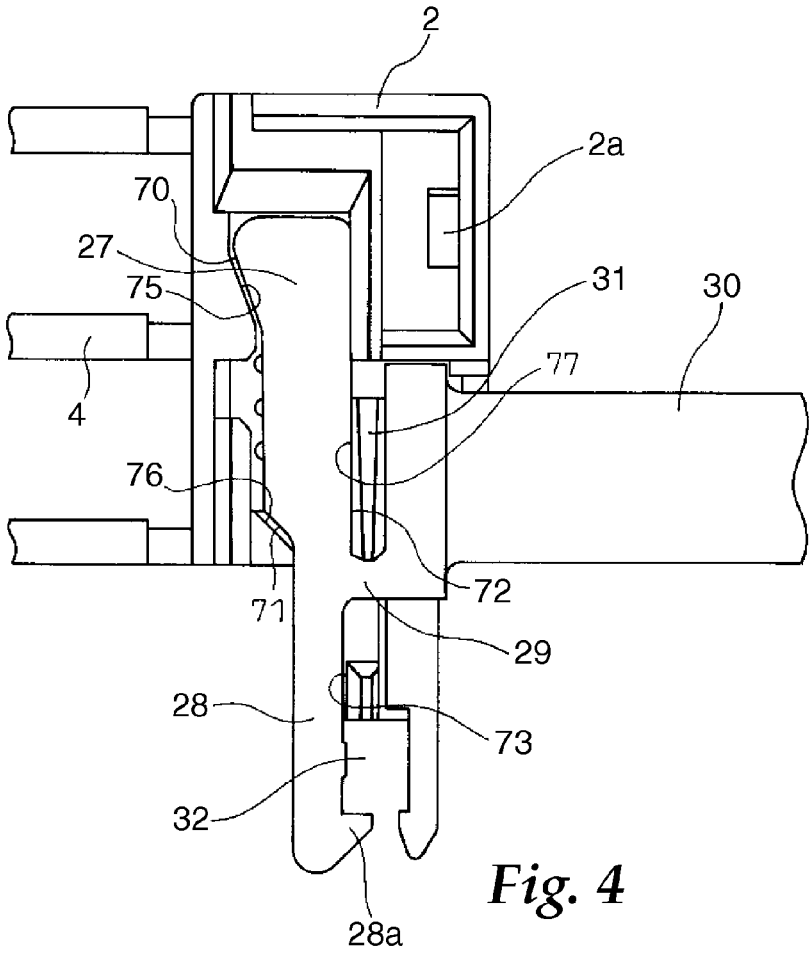
FIG. 4 is a side view of one cover member of the connector protective cover of FIG. 3 mounted on a latch lever of a connector.

The pair of cover members 2 and 3 have an interior shape that matches the profile of the latch lever 26 so that no gap is formed relative to the operating portion 27 when the operating portion 27 of the latch lever 26 is held between the pair of cover members 2 and 3. That is, the cover members 2 and 3 each have an internal structure whose shape matches the profile of the operating portion 27. More specifically, as shown in FIG. 4, the operating portion 27 has a first limiting face 70 inclined obliquely at its free end, a second limiting face 71 inclined obliquely near fulcrum portion 29, and a third limiting face 72 of a U-shaped form defining the deflection space 31; on the other hand, one cover member 2 has a first abutting face 75 which butts against the first limiting face 70, a second abutting face 76 which butts against the second limiting face 71, and a third abutting face 77 which butts against the U-shaped third limiting face 72.

Figure 5:
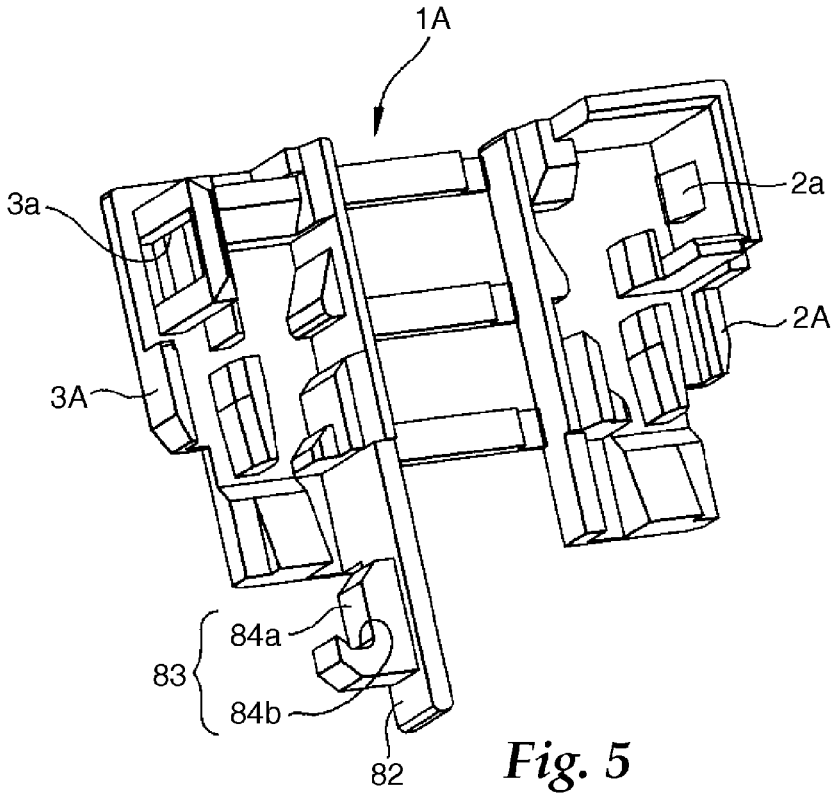
FIG. 5 is a perspective view of a modified version of the first embodiment of the protective cover.

Therefore, when the pair of cover members 2 and 3 are attached to the operating portion 27 and joined with each other, the first to third limiting faces 70, 71, and 72 contact the first to third abutting faces 75, 76, and 77 respectively, thereby limiting the vertical and horizontal movements of the pair of cover members 2 and 3 and thus holding the pair of joined cover members 2 and 3 in position so that they do not disengage from the operating portion 27, while directly limiting the deflection of the operating portion 27. When the deflection of the operating portion 27 is limited, the deflection of the engagement effecting portion 28 is also limited. A limiting portion 73 for limiting the deflection of the engagement effecting portion 28 in the closing direction protrudes from the lower part of the cover member 2. Here, as shown in FIG. 5, the wall portions of the pair of cover members 2 and 3 may be extended downward to conform to the engagement effecting portion 28 of the latch lever 26, and the extended portions may be made to engage with a plastic cover 81 mounted on a circuit board 80 (FIGS. 6 and 7); by so doing, the deflection of the engagement effecting portion 28 can also be restrained or limited directly. This modified example will be described in detail later.

Between the pair of cover members 2 and 3 to be overlaid one on top of the other when joined together, an engaging pawl (engaging portion) 2*a* is formed in protruding fashion on the inside of the wall portion of the cover member 2 in such a manner as to face inward, and an engaging hole (mating portion) 3*a* is formed passing through the wall portion of the other cover member 3 at a position corresponding to the engaging pawl 2*a*. The pair of cover members 2 and 3 are placed opposite each other in such a manner as to sandwich the latch lever 26 therebetween and, in this position, the pair of cover members 2 and 3 are joined together with the engaging pawl 2*a* engaging in the engaging hole 3*a*; in this way, the pair of cover members 2 and 3 are joined together in an secure manner, and optionally an inseparable manner. Furthermore, as the engaging portion where the engaging pawl 2*a* engages with the engaging hole 3*a* is located inside the pair of cover members 2 and 3, the engaging portion is not visible from the outside, and the engaging pawl 2*a* cannot be disengaged from the engaging hole 3*a*, that is, the pair of cover members 2 and 3 cannot be separated from each other unless the pair of cover members 2 and 3 are destroyed.

As described above, according to the protective cover 1 of the first embodiment, as the pair of cover members 2 and 3 are securely joined together to cover the operating portion 27 of the latch lever 26, the operating portion 27 can no longer be operated, and if the cover members are inseparably joined together, removal of the connector can thus be prevented. This serves to prevent illegal tampering which is done, for example, by illegally controlling a game machine or the like mounted with the circuit board. If illegal tampering is done by destroying the protective cover 1, the illegal tampering can be easily discovered as the destroyed protective cover 1 provides the evidence of illegal tampering. Furthermore, as the protective cover 1 is designed to selectively protect only the operating portion 27 of the latch lever 26, the structure can be made compact, and the mounting space can be reduced.

Figure 6:
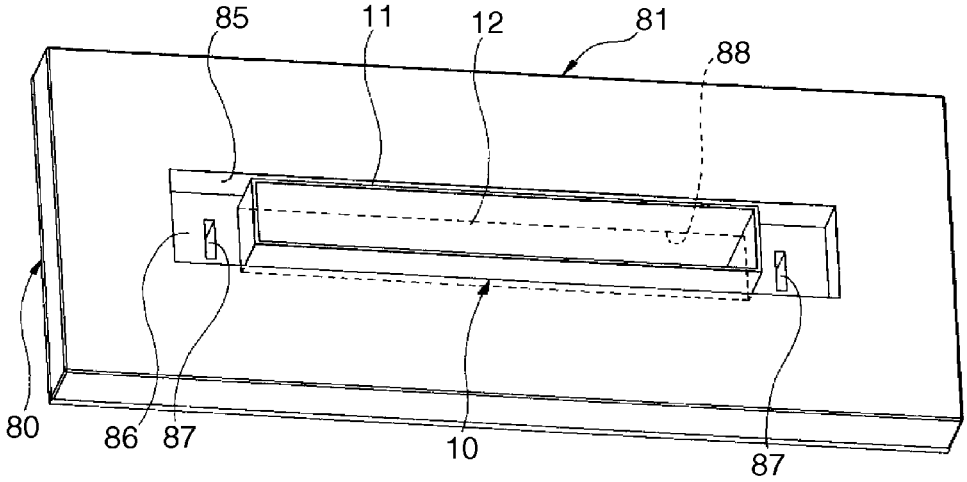
FIG. 6 is a perspective view of a plastic cover having an opening passing therethrough.

FIG. 5 shows the modified example of the first embodiment. In this modified example, a downwardly extending leg portion 82 is formed on one cover member 3A. An L-shaped abutting portion 83 which butts against the lower end of the engagement effecting portion 28 of the latch lever 26 is formed on the inside face of the leg portion 82. The abutting portion 83 has a vertical first abutting face 84*a* and a curved second abutting face 84*b*. The leg portion 82 is designed to engage into a hole (engaging portion) 87 formed in the wall portion of the board plastic cover (substrate cover) 81 mounted on the circuit board 80. The hole 87 is shown in FIG. 6. The board plastic cover 81 is a cover (typically transparent) rigidly mounted on the upper surface of the board to prevent tampering with the circuit board 80. A portion of the cover 81 is shown in FIG. 6. Once the board plastic cover 81 is mounted on the circuit board 80, the cover 81 cannot be removed without destroying it. In other words, a destroyed board plastic cover 81 provides evidence indicating that the game machine has been tampered with. A cable is connected to the game machine via a connector; here, a mounting portion 85 where the cover height is lower than the surrounding portion is formed in the board plastic cover 81 at a portion thereof corresponding to a connector connecting portion so that an authorized service person can attach or detach the connector as needed. The mounting portion 85 is provided with an opening 88 through which the connector 10 is mounted on the board 80. In this embodiment, the opening 88 is provided in the form of a hole, but in such cases as when the connector is mounted to an edge or like portion of the board 80, the opening 88 need not necessarily be provided in the form of a hole, but may be provided in the form of a cut-out that matches the connector shape. Further, if the cover height is low enough so as not to interfere with the connector attaching/detaching action, only the opening 88 need be provided.

Figure 7:
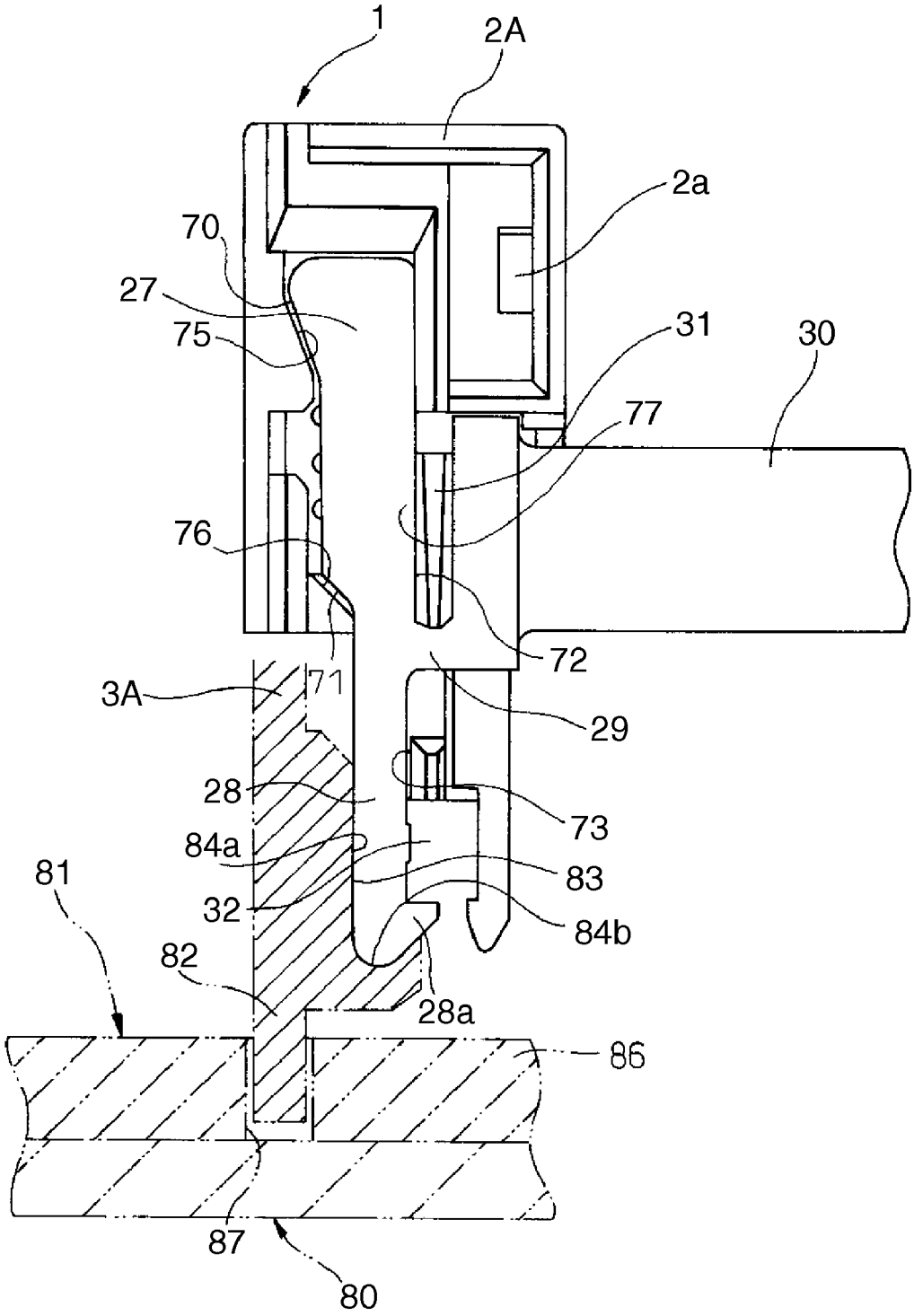
FIG. 7 is a partially cross-sectional side view of the protective cover of FIG. 5 mounted on a latch lever of a connector.

FIG. 7 shows the condition in which the cover member 3A is fitted onto the engaging effecting portion 28 of the latch lever 26. The leg portion 82 of the cover member 3A is engaged into the hole 87 provided in a horizontal wall portion 86 that is formed around the opening 88 and held in contact with the circuit board 80. Here, the L-shaped abutting portion 83 formed continuously with the leg portion 82 is made to butt against the outside face of the engagement effecting portion 28. More specifically, the vertical outside face of the engagement effecting portion 28 engages with the vertical first abutting face 84*a* of the abutting portion 83, while the curved outside face at the forward end of the engagement effecting portion 28 engages with the curved second abutting face 84*b* of the abutting portion 83. With the second abutting face 84*b* engaged with the curved outside face at the forward end of the engagement effecting portion 28, the protective cover 1A is also prevented from coming off. When the leg portion 82 (restraining portion) is engaged into the hole 87 in this way, the movement of the leg portion 82 is restrained, and as a result, the movement of the engagement effecting portion 28 engaging with the abutting portion 83 is also restrained. The engaged position here not only refers to the position in which the latch lever and the cover member are constantly held in contact with each other, but also includes the position in which a gap is formed between the engagement effecting portion and the abutting portion that limits movement of the engagement effecting portion to such a degree as not to allow the latch engagement to be released.

According to the modified example of the protective cover 1A, the cover body covers the operating portion 27 of the latch lever 26 to prevent access to the operating portion 27, and the leg portion 82 of the protective cover 1A restrains the movement of the engagement effecting portion 28 of the latch lever 26, reliably preventing the latch lever 26 from being disengaged.

In the above modified example, the leg portion 82 of the protective cover 1A is adapted to engage in the hole 87 formed in the board plastic cover 81, but this does not impose any restrictions on the structure of the portion into which the leg portion 82 is inserted; for example, the hole 87 may be changed to a depression or may be formed in the circuit board 80 or in a wall formed by extending a portion of the connector 10 in parallel to the board surface.

Next, a second embodiment of a protective cover according to the present invention will be described with reference to FIGS. 8 to 12. Like the protective cover 1 of the first embodiment, the protective cover 40 of the second embodiment is also applied to a board connector assembly 48. Like the first embodiment, the board connector assembly 48 may also comprise a 40-pin direct-mount connector 50 and a cable connector 60. In the present embodiment, descriptions already given in the first embodiment will not be repeated, and only the differences in structure will be described. It will, however, be noted that the protective cover 40 of the second embodiment hereinafter described can also be applied to the pair of latch levers 2 and 3 of the connector 20 described in the first embodiment.

The direct-mount connector 50 of the present embodiment differs from the direct-mount connector 10 of the first embodiment in that the connector 50 comprises a connector housing 51, a large number of male terminals, and latch levers 52. The protective cover 40 of the present embodiment is mounted in such a manner that it will not come off the operating portions 53 of the latch levers 52.

Figure 9:
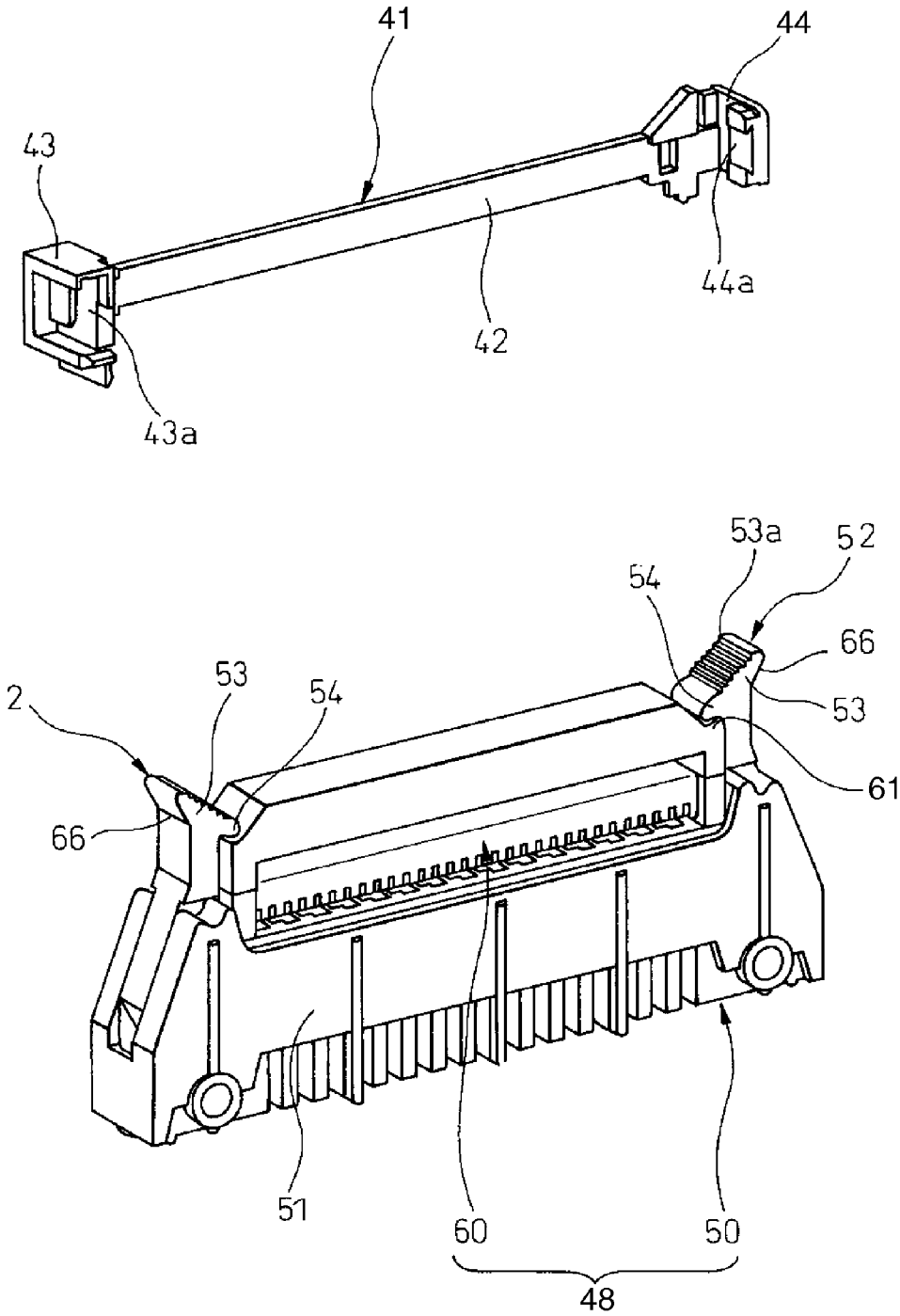
FIG. 9 is a perspective view of one cover member of the connector protective cover of FIG. 8 and mated connectors on which it may be mounted.
Figure 10:
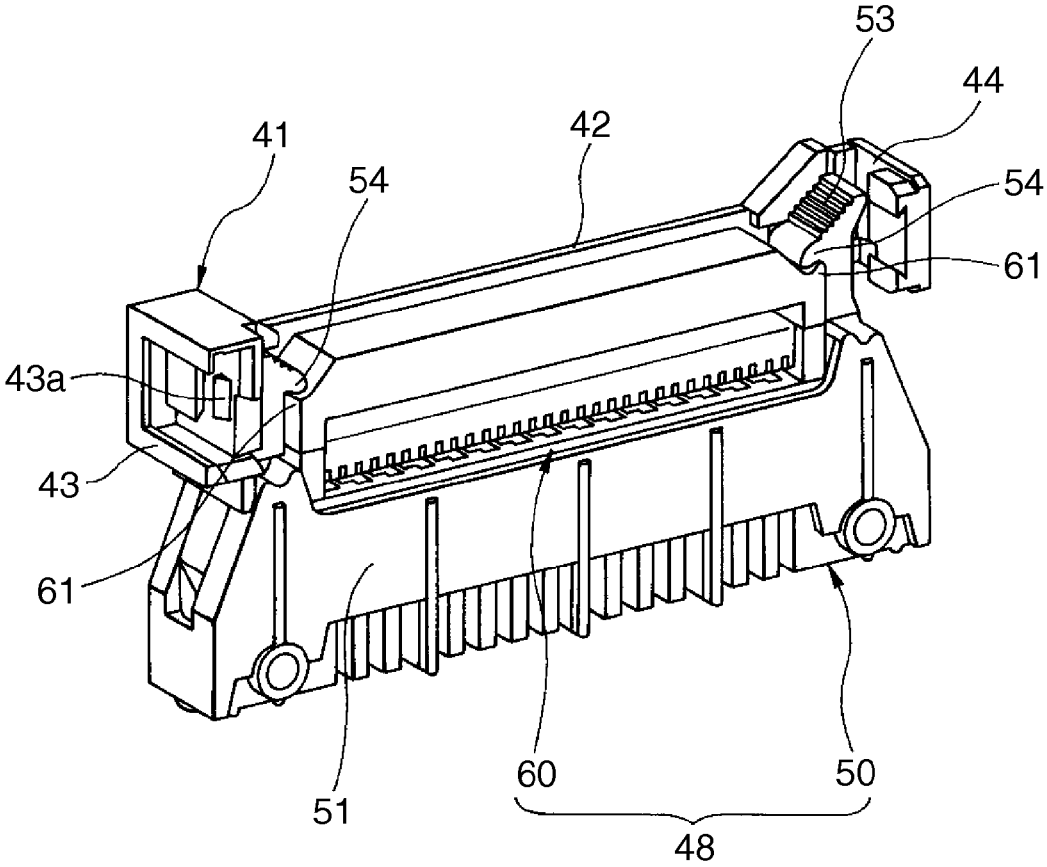
FIG. 10 is a perspective view of one cover member of the connector protective cover of FIG. 8 mounted on mated connectors.
Figure 11:
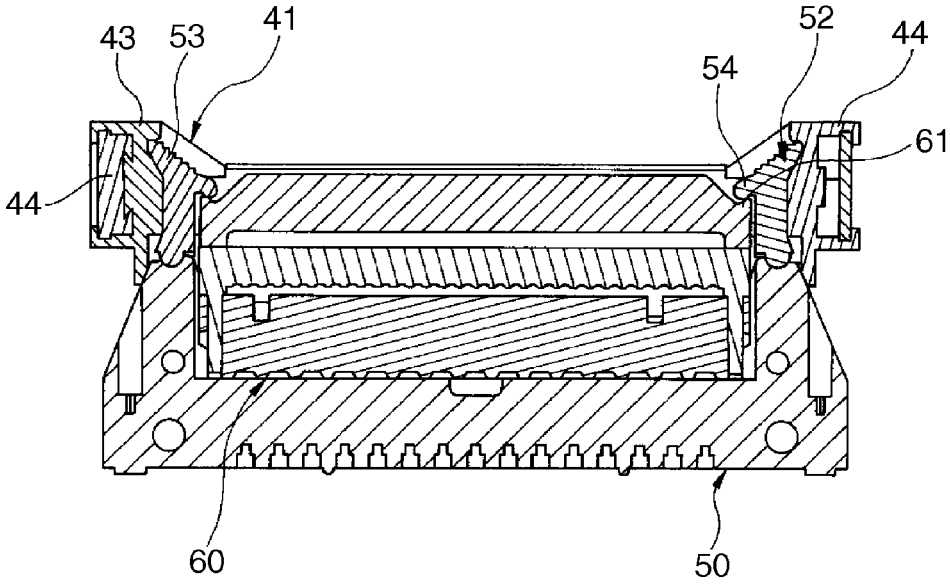
FIG. 11 is a cross-sectional side view of the cover member and connectors of FIG. 10.

As shown in FIGS. 9 and 10, the latch levers 52 are pivotably mounted at both ends of the connector housing 51, one separated from the other along the longitudinal direction thereof. One end of each latch lever 52 is rotatably supported at one end of the connector housing 51 via a shaft (not shown). At the other end of each latch lever 52 is formed an engagement effecting portion 54 as well as the operating portion 53 having an outer surface 66 that is curved inward. A large number of thin grooves 53*a* for preventing finger slippage are formed on an end face of the operating portion 53. The engagement effecting portion 54 as an engaging portion is formed in such a manner as to protrude in a direction that faces the other latch lever 52, and engages with a step portion 61 of the cable connector 60, thereby preventing the cable connector 60 from disengaging.

The latch lever 52 is movable between an engaging position where the pair of connectors 50 and 60 are retained in engagement with each other and a disengaging position where the pair of connectors 50 and 60 are released from the engagement, and is held fixed in each position by a stopper not shown. Therefore, when fitting together the pair of connectors 50 and 60, first the pair of latch levers 52 are opened (rotated outward) and set in the disengaging position, and one connector is fitted into the other; after that, the pair of latch levers 52 are closed (rotated inward) and set in the engaging position, thereby holding the pair of connectors 50 and 60 in engagement with each other. When disconnecting the pair of connectors 50 and 60, the pair of latch levers 52 are opened outward into the disengaging position by applying a prescribed force, thus allowing the disengagement of the connectors.

Figure 8:
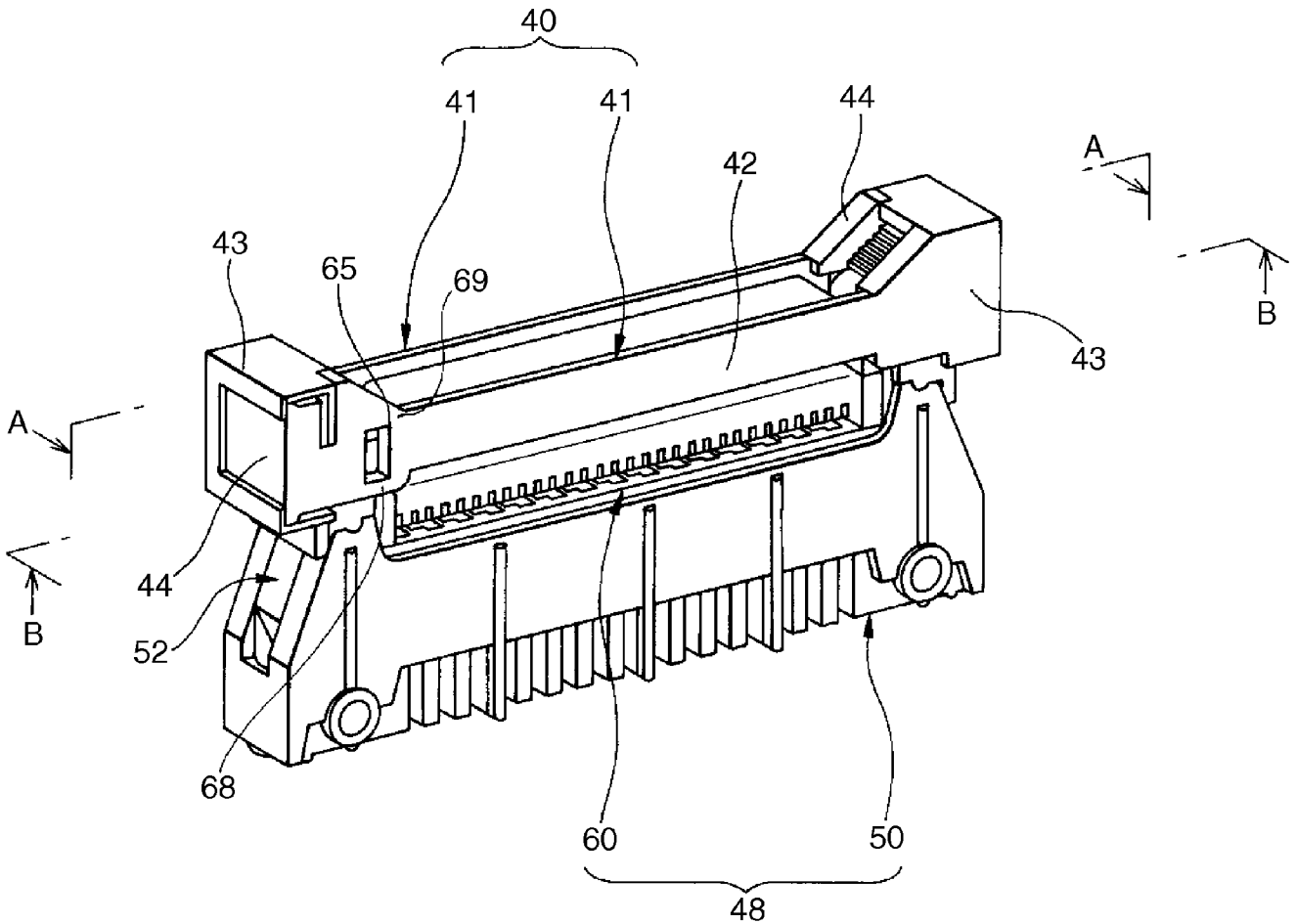
FIG. 8 is a perspective view of a second embodiment of a connector protective cover according to the present invention attached to mated connectors.
Figure 12:
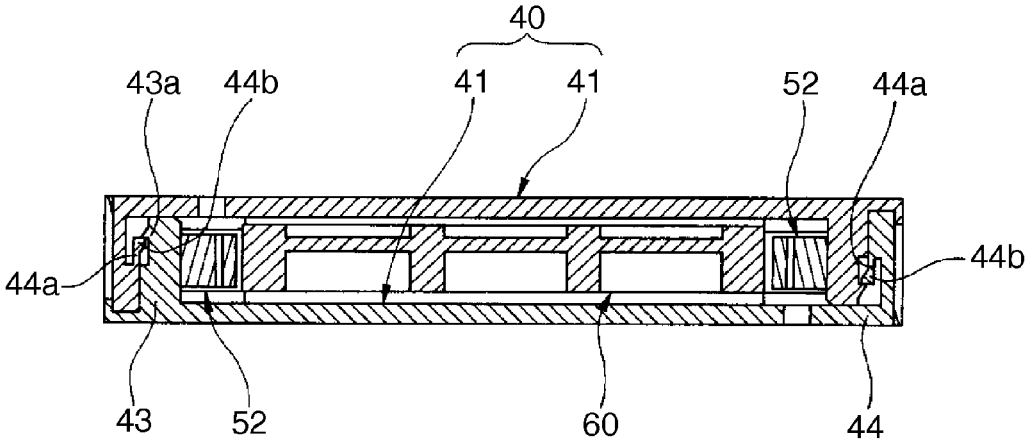
FIG. 12 is a cross-sectional top view of the connector protective cover and connectors of FIG. 8.

The protective cover 40 of the present embodiment comprises a pair of cover members 41 facing each other and forming a frame member when joined together (FIGS. 8 and 12). The pair of mating cover members 41 have a symmetrical shape. The cover members 41 may be formed by molding a resin into the desired shape. Two cover members 41 are joined together to construct the protective cover 40 having a frame-like shape.

The cover members 41 each comprise a longitudinal connecting portion 42 extending parallel to the side face of the cable connector 60 between the pair of latch levers 52, and mounting portions 43 and 44 integrally formed with the respective ends of the connecting portion 42 and attached to the pair of connectors 50 and 60 so as to cover the outside portions of the operating portions 53 of the respective latch levers 52. The connecting portion 42 has a thin wall thickness. Further, portions (breakage facilitating portions) 68 and 69, i.e., reduced thickness portions around a hole 65, for promoting separation in the event of breakage of the pair of cover members 41 are formed on the side face of the connecting portion 42. When these portions 68 and 69 are cut off by nippers or the like, the pair of cover members 41 can be easily separated.

When the pair of cover members 41 are joined together to form a frame member and mounted on the operating portions 53 with the frame member held in contact with the curved faces 66 of the operating portions 53, the pair of latch levers 52 are prevented from being rotated outward, and the pair of connectors 50 and 60 are held in engagement with each other, while at the same time, the vertical and horizontal movements of the pair of cover members 41 (the protective cover 40) are limited, preventing the pair of cover members 41 from disengaging from the operating portions 53.

Protective cover 40 may also be used with mated connectors 10 and 20 of the first embodiment. When applying the protective cover 40 of the present embodiment to the pair of latch levers 26 of the connector 20 of the first embodiment, the mounting portions of the cover members are provided with portions for limiting the deflection of the operating portions 27 of the latch levers 26, and the cover members are mounted on the outside of the pair of operating portions 27 in contacting relationship with the first and second limiting faces 70 and 71 of the respective operating portions 27 so as to prevent the protective cover 40 from disengaging from the pair of latch levers 26. Because the protective cover 40 of the present embodiment is simple and compact in structure, the outward projection of the latch lever 26 or 52 is correspondingly reduced, making the structure less susceptible to mounting space constraints.

As shown in FIG. 12, between the pair of mounting portions 43 and 44 to be overlaid one on top of the other when joined together, an engaging pawl (engaging portion) 43*a* is formed in protruding fashion on the wall surface of one mounting portion 43, and a flexible engaging arm (mating portion) 44*a* having a pawl 44*b* at its end is formed in such a manner as to rise from the wall of the other mounting portion 44 at a position corresponding to the engaging pawl 43*a*. The flexible engaging arm 44*a* is formed spaced apart from a wall surface that is perpendicular to the wall surface to which the base of the engaging arm 44*a* is connected. As a result, if the wall of the mounting portion 44 is deflected by an external force, the engaging arm 44*a* is not easily affected by the deflection of the wall, and the reliability of the engagement between the engaging pawl 43*a* and the pawl 44*b* of the engaging arm 44*a* thus improves.

As the pair of cover members 41 of the present embodiment has a symmetrical shape, the mounting portion 43 formed at one end of the connecting portion 42 is provided with the engaging pawl 43*a*, while the mounting portion 44 formed at the other end of the connecting portion 43 is provided with the engaging arm 44*a* having the pawl 44*b* at its end. When the pair of mounting portions 43 and 44 are held facing each other and are joined together in sliding fashion, the engaging arm 44*a* is first deflected by being pressed by the engaging pawl 43*a*, and then elastically returns to its original position, causing the pawl 44*b* of the engaging arm 44*a* to engage with the engaging pawl 43*a*, and thus the pair of mounting portions 43 and 44 are joined together in a secure manner, and optionally an inseparable manner.

When the pair of mounting portions 43 and 44 are thus joined together, the engaging portion where the engaging pawl 43*a* engages with the pawl 44*b* of the engaging arm 44*a* is located inside the pair of mounting portions 43 and 44. As a result, the engaging portion is neither visible nor accessible from the outside, and the pair of mounting portions 43 and 44 can thus be prevented from being disengaged.

As described above, according to the second embodiment, the pair of cover members 41 when joined together forms a frame member which covers the operating portions 53 of the latch levers 52 while restraining the outward movement of the latch levers 52 by the frame-like protective cover 40; as a result, the pair of connectors 50 and 60 cannot be disconnected, preventing (illegal) removal of the connectors 50 and 60. Furthermore, as the pair of cover members 41 are designed to cover only the areas surrounding the operating portions 53, the protective cover 40 comprising the pair of cover members 41 can be provided as a compact component that can reduce the mounting space.

Figure 13:
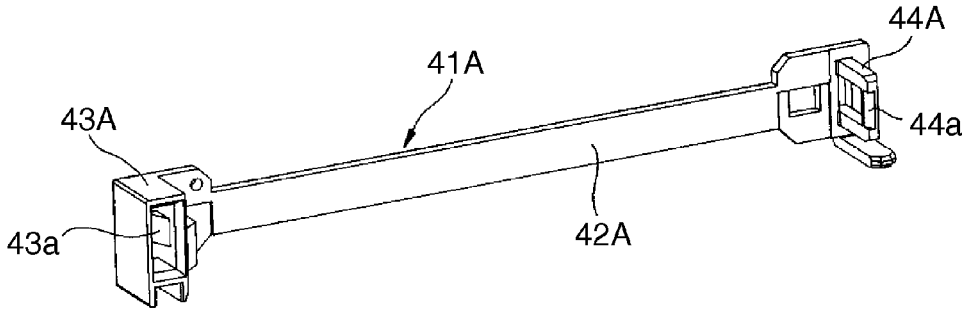
FIG. 13 is a perspective view of a cover member of a modified version of the second embodiment of the protective cover.
Figure 14:
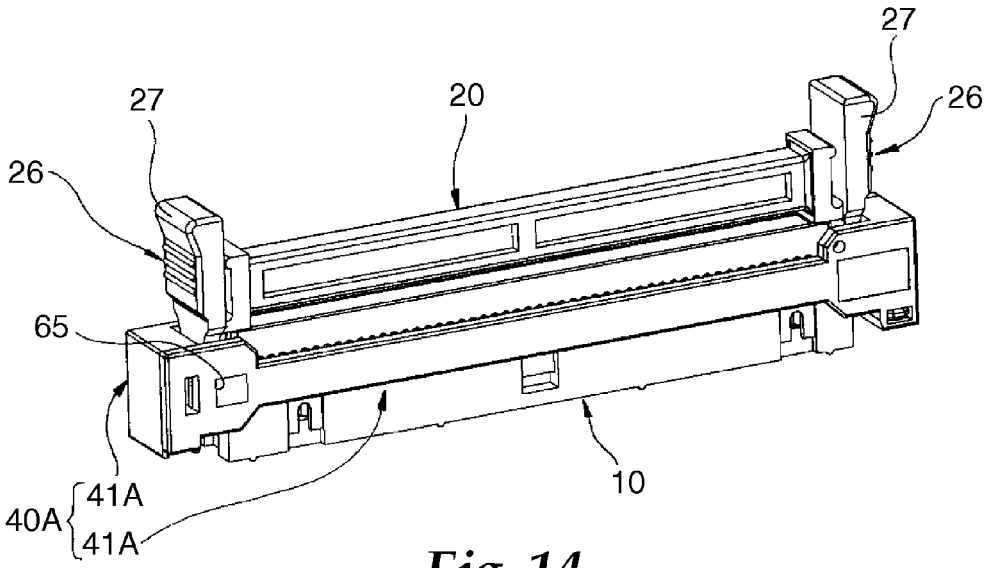
FIG. 14 is a perspective view of a pair of the cover members of FIG. 13 mounted on latch levers of a connector.

FIGS. 13 and 14 show a modified example of the second embodiment. In this modified example, a pair of cover members 41A are mounted on the latch levers 26 so as to cover the engagement effecting portions 28 of the latch levers 26. The pair of connectors 10 and 20 used here are the same as that shown in the first embodiment. Each cover member 41A comprises a long length connecting portion 42A and mounting portions 43A and 44A integrally formed with the respective ends of the connecting portion 42A. The pair of cover members 41A of this modified example are the same in structure as the pair of cover members 41 of the second embodiment, except that the structures of the mounting portions 43A and 44A are different from that of the mounting portions 43 and 44 of the second embodiment. In the mounting portion 43A, an engaging pawl 43*a* is formed in protruding fashion on the inside surface of the wall nearer to the mounting portion 44A, while on the other hand, the mounting portion 44A is provided with an engaging arm 44*a* having a hole that engages on the engaging pawl 43*a* of the other cover member.

According to the above modified example, because the pair of cover members 41A are mounted on the latch levers 26 so as to cover the engagement effecting portions 28 of the latch levers 26, they can directly prevent the connectors 10 and 20 from being removed, for example, by prying the exposed engagement effecting portions 28 of the latch levers 26. Furthermore, because the engagement effecting portions 28 are located inside the frame formed when the cover members 41A are joined together, and the engagement effecting portions 28 are thus retrained from moving outwardly, this modified example offers the advantage that the movement of the engagement effecting portions 28 of the latch levers 26 can be restrained without forming holes 87 in the plastic cover 81 as in the modified example of the first embodiment.

Next, a third embodiment of a protective cover according to the present invention will be described with reference to FIGS. 15 to 18. The protective cover 90 of the third embodiment may be injection molded as a one-piece structure, and in this respect differs from the hinged type protective cover 1 of the first embodiment or the symmetrical two-part protective cover 40 of the second embodiment.

Figure 15:
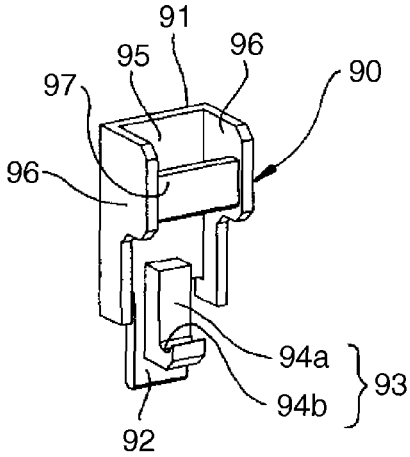
FIG. 15 is a perspective view of a third embodiment of a connector protective cover according to the present invention.

The protective cover 90 of the present embodiment shown in FIG. 15 is constructed so that when the cover body 91 is mounted on the engagement effecting portion 28 of the latch lever 26, the leg portion 92 extending downwardly from the cover body 91 engages with the plastic cover 81 mounted on the upper surface of the circuit board 80. While the plastic cover 81 is not limited to any specific shape, the same one as that shown in the modified example of the first embodiment can also be used here. Further, the latch lever 26 to which the protective cover 90 of the third embodiment is applied is the same as that shown in the first embodiment.

Figure 16:
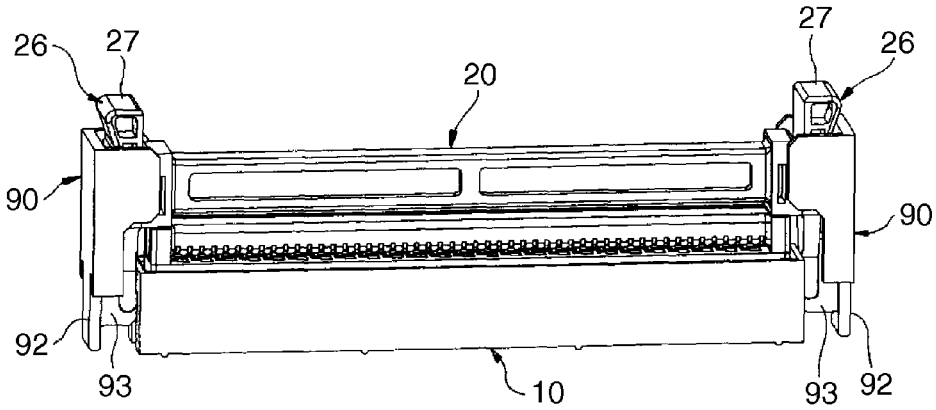
FIG. 16 is a perspective view of the connector protective cover of FIG. 15 mounted on a latch lever of a connector.

The protective cover 90 comprises: the cover body 91 to be mounted on the engagement effecting portion 28 of the latch lever 26; the leg portion 92 formed continuously with the cover body 91 so as to extend downwardly of the cover body 91; and the abutting portion 93, formed on the inside surface of the leg portion 92, for restraining the movement of the engagement effecting portion 28. The cover body 91 includes a base wall 95, a pair of side walls 96 formed on both sides of the base wall 95 so as to extend vertically therefrom, and a connecting wall 97 connecting the pair of side walls 96. The upper end of the latch lever 26 is inserted through the lower end opening bounded by the walls 95, 96, and 97, and the cover body 91 is moved downward until the upper end of the latch lever 26 protrudes from the upper end opening of the cover body 91; then, the cover is held in position with the cover body 91 covering the engagement effecting portion 28 of the latch lever 26. That is, the cover is mounted on the latch lever 26 with the upper end of the operating portion 27 exposed and with the cover body 91 covering the engagement effecting portion 28, as shown in FIG. 16.

Figure 17:
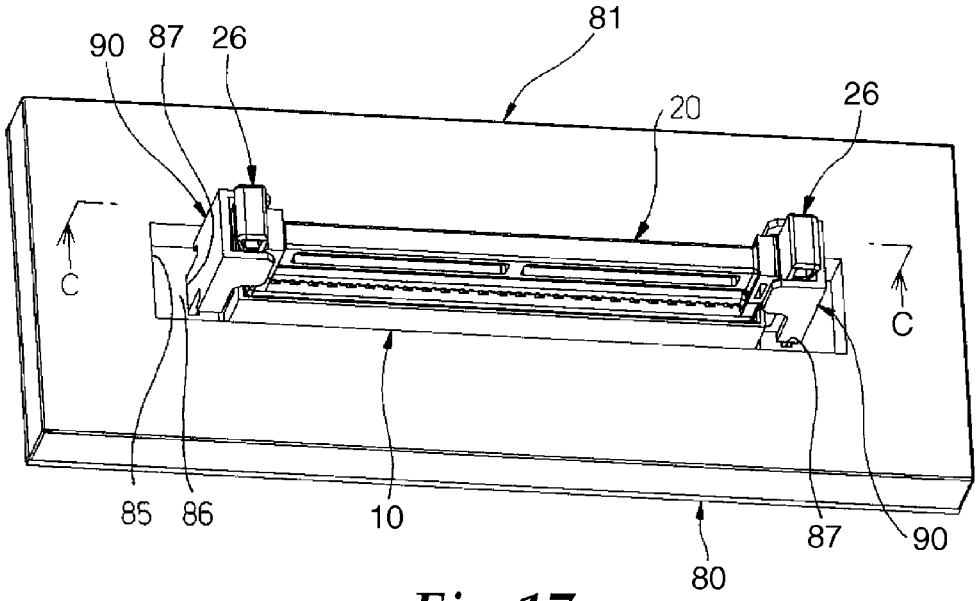
FIG. 17 is a perspective view of a connector mounted through an opening of a plastic cover.
Figure 18:
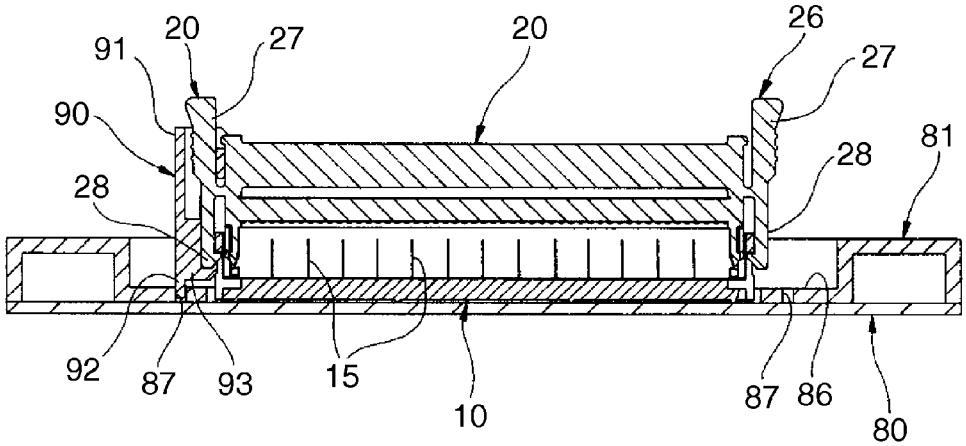
FIG. 18 is a cross-sectional view taken along line C-C in FIG. 17.

As shown in FIGS. 17 and 18, the leg portion 92 is engaged into the hole 87 provided in the horizontal wall portion 86 that is formed around the mounting portion 85 of the plastic cover 81 and held in contact with the circuit board 80. As shown in FIG. 18 (the protective cover 90 is mounted only on one side), the L-shaped abutting portion 93 formed continuously with the leg portion 92 butts against the outside face of the engagement effecting portion 28, directly restraining the movement of the engagement effecting portion 28. The abutting portion 93 has a vertical first abutting face 94*a* and a curved second abutting face 94*b*. The vertical outside face of the engagement effecting portion 28 engages with the vertical first abutting face 94*a* of the abutting portion 93, while the curved outside face at the forward end of the engagement effecting portion 28 engages with the curved second abutting face 94*b* of the abutting portion 93. With the second abutting face 94*b* engaged with the curved outside face at the forward end of the engagement effecting portion 28, the protective cover 90 is also prevented from coming off. When the leg portion 92 is engaged into the hole 87 in this way, the engagement effecting portion 28 is prevented from moving from the engaging position where the pair of connectors 10 and 20 are held in engagement with each other to the disengaging position where the pair of connectors 10 and 20 are released from the engagement.

In the present embodiment, the leg portion 92 of the protective cover 90 is adapted to engage in the hole 87 formed in the plastic cover 81, but this does not impose any restrictions on the structure of the portion into which the leg portion 92 is inserted; for example, the hole 87 may be changed to a depression or may be formed in the circuit board 80 or in a wall formed by extending a portion of the connector 10 in parallel to the board surface. Further, the upper end of the latch lever 26 is allowed to protrude through the upper end opening of the protective cover 90, but the protective cover 90 may be made longer so that the operating portion 27 of the latch lever 26 can also be accommodated within the protective cover 90.

As described above, according to the third embodiment, when the protective cover 90 is mounted on the engagement effecting portions 28 of the latch levers 26, the leg portion 92 engages in the hole 87 formed in the plastic cover 81, thus holding the protective cover 90 in a fixed position relative to the latch lever 26, and the abutting portion 93 butts against the outside face of the engagement effecting portions 28, restraining the movement of the engagement effecting portion 28 directly. Accordingly, by using the protective cover 90, which is simple in structure, illegal operation of the latch lever 26 can be reliably prevented.

The present invention is not limited to the specific embodiments described above, but can also be carried out in other embodiments. In the first embodiment of the connector protective cover, the pair of cover members 2 and 3 have been described as having an interior shape that matches the profile of the operating portion 27, but instead, the wall portions of the pair of cover members 2 and 3 may be formed to have a box-like shape when joined together, as long as the pair of cover members cover the operating portion 27 and are mounted so as not to be separated from the operating portion 27. Further, in the first embodiment, the protective cover 1 is applied to the operating portions 27 of the two latch levers 26, but if the protective cover 1 is applied to only one side, illegal removal of the connector can also be prevented.

In the second embodiment, the pair of cover members 41 form a frame member when joined together, but as a modified example, the pair of cover members 41 may be formed to have a box-like shape when joined together so as to cover the pair of operating portions 53 from above, as long as the pair of cover members 41 can be joined together so as not to be separated from the operating portions 53.

Further, in the first embodiment, the pair of cover members 2 and 3 are joined together by engaging the engaging pawl 2*a* with the engaging hole 3*a* formed on the walls of the respective cover members 2 and 3, and in the second embodiment, the pair of cover members 41 are joined together by engaging the engaging pawl 43*a* with the pawl 44*b* of the engaging arm 44*a* formed on the walls of the respective mounting portions 43 and 44; however, rather than using such engaging means, the pair of cover members 2 and 3 or 41 may be joined together in a secure manner, and optionally an inseparable manner using, for example, an adhesive or a strong double-sided adhesive tape.

The invention claimed is:

1. A connector protective cover suitable for protecting a latch lever that is operated to retain a pair of connectors in engagement with each other; wherein the latch lever has an operating portion and an engagement effecting portion, the operating portion being operable to move the engagement effecting portion between an engaging position where the pair of connectors are retained in engagement with each other and a disengaging position where the pair of connectors are released from the engagement, the connector protective cover comprising a pair of mating cover members configured to protect the latch lever;

wherein the pair of cover members are configured to join together in a secure manner accommodating one or both of the operating portion and the engagement effecting portion of the latch lever and are further configured to couple with one or both of the pair of connectors, wherein the pair of cover members has a breakage facilitating portion for enabling separation of the pair of cover members.

2. A connector protective cover of claim 1 wherein the pair of mating cover members are configured to join together in an inseparable manner.

3. A connector protective cover of claim 1 wherein the cover members are further configured to restrain movement of the engagement effecting portion.

4. A connector protective cover of claim 1, wherein one of the cover members has a first wall portion, the other cover member has a second wall portion opposed to the first wall portion when the pair of cover members are joined together; and wherein the first wall portion has an engaging portion, and the second wall portion has a mating portion configured to engage with the engaging portion.

5. A connector protective cover of claim 1, wherein the breakage facilitating portion is a flexible hinge portion which is integrally formed with an adjacent wall portion of the cover members in order to interconnect the paired cover members.

6. A connector protective cover of claim 1 for use with a connector latch lever in which the operating portion of the latch lever has a first limiting face and a second limiting face, wherein the pair of cover members are configured to be joined together while accommodating the operating portion of the latch lever, and the cover members having a first abutting face configured to butt against the first limiting face and a second abutting face configured to butt against the second limiting face such that vertical and horizontal movements of the pair of cover members joined together are limited.

7. A connector protective cover of claim 1, for use with a connector latch lever in which the latch lever is elastically supported on one of the pair of connectors by means of a fulcrum located between the operating portion formed at one end and the engagement effecting portion formed at the other end, and when the operating portion is pressed and deflected, the engagement effecting portion is moved between the engaging position and the disengaging position, wherein the pair of cover members have an internal structure whose shape matches the shape of the operating portion, and the paired cover members are configured to join together while accommodating the operating portion such that the operating portion will contact an inner wall of at least one cover member.

8. A connector protective cover of claim 1, wherein each of the cover members has a connecting portion and a pair of mounting portions connected at both ends of the connecting portion, and when the pairs of mounting portions are respectively joined together, the pair of cover members form a frame member configured to hold at least one latch lever.

9. A connector protective cover of claim 8, wherein an engaging portion is provided on one of the mounting portions and a mating portion is provided on the other mounting portion.

10. A connector protective cover of claim 8, wherein the breakage facilitating portion is provided in the connecting portion.

11. A connector protective cover of claim 8 for use with a latch lever having, at one end, the operating portion having a curved face and the engagement effecting portion, and at the other end, a fulcrum portion via which the latch lever is pivotably supported, wherein the pair of cover members are configured to join together while accommodating the operating portion with the pair of cover members contacting the curved face of the operating portion of the latch lever.

12. An article comprising a connector protective cover and a pair of engaged connectors at least one of the connectors having a latch lever to retain their engagement with each other, the connector protective cover having a pair of mating cover members to be joined together to protect the latch lever;

wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement; and wherein the pair of cover members joined together in a secure manner accommodate one or both of the operating portion and engagement effecting portion and are fixed to one or both of the pair of connectors, wherein the pair of cover members are configured to be joined together by accommodating the operating portion therein, and wherein a first limiting face and a second limiting face are formed on the operating portion of the latch lever, a first abutting face which butts against the first limiting face and a second abutting face which butts against the second limiting face are formed on the pair of cover members, and vertical and horizontal movements of the pair of cover members joined together are limited with the first limiting face contacting the first abutting face and the second limiting face contacting the second abutting face.

13. An article of claim 12, wherein the pair of connectors are electrically connected between a circuit board and a flat cable.

14. An article comprising a connector protective cover and a pair of engaged connectors at least one of the connectors having a latch lever to retain their engagement with each other, the connector protective cover having a pair of mating cover members to be joined together to protect the latch lever;

wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement; and wherein the pair of cover members joined together in a secure manner accommodate one or both of the operating portion and engagement effecting portion and are fixed to one or both of the pair of connectors, wherein one of the pair of connectors is a direct-mounted type connector direct mounted on a circuit board, and the other one of the pair of connectors is a cable connector connected with a cable, wherein a board cover having an opening passing therethrough to define a mounting space for mounting the direct-mount connector in a position to which the direct-mount connector is to be fixed is rigidly mounted on an upper surface of the circuit board; and wherein one of the pair of cover members comprises a leg portion which engages with a wall portion formed around the opening of the board cover, and a restraining portion which restrains movement of the engagement effecting portion by abutting against an outside face of the engagement effecting portion with the leg portion engaged with the wall portion formed around the opening.

15. An article comprising a connector protective cover and a pair of engaged connectors at least one of the connectors having a latch lever to retain their engagement with each other, the connector protective cover having a pair of mating cover members to be joined together to protect the latch lever;

wherein the latch lever has an operating portion and an engagement effecting portion, and when the operating portion is operated, the engagement effecting portion is moved between an engaging position where the pair of connectors are retained in engagement with each other and a disengaging position where the pair of connectors are released from the engagement; and wherein the pair of cover members joined together in a secure manner accommodate one or both of the operating portion and engagement effecting portion and are fixed to one or both of the pair of connectors, wherein the connector protective cover is mounted on a latch lever that is provided on one or both of a direct-mount connector directly mounted to a circuit board or a cable connector connected to a cable and that is operated to retain the direct-mount connector and the cable connector in engagement with each other, wherein a board cover having an opening passing therethrough to define a mounting space for mounting the direct-mount connector in a position to which the direct-mount connector is to be fixed is rigidly mounted on an upper surface of the circuit board, and the latch lever has an operating portion and an engagement effecting portion, the operating portion being operable to move the engagement effecting portion between an engaging position where the pair of connectors are retained in engagement with each other and a disengaging position where the pair of connectors are released from the engagement, wherein the connector protective cover has a body which is to be mounted at least on the engagement effecting portion, a leg portion which engages with a wall portion formed around the opening of the board cover, and a restraining portion which retrains movement of the engagement effecting portion by abutting against an outside face of the engagement effecting portion with the leg portion engaged with the wall portion formed around the opening.

16. A connector protective cover of claim 15, wherein an engaging portion is provided on the peripheral wall of the opening, the engaging portion engaging with the leg portion.

* * * * *

UNITED STATES PATENT AND TRADEMARK OFFICE

CERTIFICATE OF CORRECTION

PATENT NO. : 8,038,459 B2
APPLICATION NO. : 12/526374
DATED : October 18, 2011
INVENTOR(S) : Takayuki Hayauchi It is certified that error appears in the above-identified patent and that said Letters Patent is hereby corrected as shown below:

Column 1, Line 4, Above "TECHNICAL FIELD" insert -- Cross Reference to Related Applications This application is a national stage filing under 35 U.S.C. 371 of PCT/US2008/053607, filed February 11, 2008, which claims priority to Japanese Application No. 2007-035240, filed February 15, 2007, and Japanese Application No. 2007-330503, filed December 21, 2007, the disclosure of which is incorporated by reference in their entirety herein. --

Signed and Sealed this
Twelfth Day of June, 2012

David J. Kappos

David J. Kappos
*Director of the United States Patent and Trademark Office*